United States Patent [19]

Woodle

[11] 4,312,594

[45] Jan. 26, 1982

[54] BLENDING VESSEL AND METHOD OF BLENDING

[75] Inventor: Robert A. Woodle, Nederland, Tex.

[73] Assignee: Texaco Inc., White Plains, N.Y.

[21] Appl. No.: 141,520

[22] Filed: Apr. 18, 1980

[51] Int. Cl.[3] ..... B01F 15/02; B01F 5/12

[52] U.S. Cl. ..... 366/150; 366/267

[58] Field of Search ..... 366/150, 91, 92, 96, 366/95, 99, 152, 158, 177, 178, 235, 241, 244, 249, 267, 291, 341, 137, 332, 333, 334, 348, 349

[56] References Cited

U.S. PATENT DOCUMENTS

| | | | |
|---|---|---|---|
| 2,560,082 | 7/1951 | Brown | 366/333 |
| 2,995,451 | 8/1961 | Leach | 366/267 X |
| 3,608,869 | 9/1971 | Woodle | 366/132 |
| 4,043,539 | 8/1977 | Gilmer | 366/341 |

*Primary Examiner*—Edward J. McCarthy

*Attorney, Agent, or Firm*—Carl G. Ries; Robert A. Kulason; H. C. Dearborn

[57] ABSTRACT

A special blending vessel lends itself to shifting from one continuously blended product to the next in a continuous flow with a sharp change so that there is substantially no mixing of the two products at the change over. There are two sets of ingredient inputs and product outputs for the blending vessel. And, there is a follower type divider that separates one set of ingredient inputs and product output from the other set. When a shift is to be made from the one product to the next, the ingredients of the second product are introduced and blended in the vessel while displacing the remainder of the one product without mixing therewith. Then the outputs are switched so that the second product follows with an abrupt change from the first product to the second.

5 Claims, 5 Drawing Figures

BLENDING VESSEL AND METHOD OF BLENDING

BACKGROUND OF THE INVENTION

1. Field of the Invention

This invention concerns blending of fluid products in general. More specifically, it relates to a particular blending vessel and a method of blending that may be carried out in connection therewith.

2. Description of the Prior Art

Heretofore, this applicant is the patentee of a system for automatically blending liquid ingredients that is shown and described in U.S. Pat. No. 3,608,869, which issued Sept. 28, 1971. That system has a drawback in that when one product consisting of a particular blend is changed to another product having a different blend, the change over necessitates a gradual shift from the first product to the next. Consequently, there is a considerable quantity of off-specification material that has to be discarded or otherwise handled.

Therefore, it is an object of this invention to provide a special blending vessel, and a method of employing such structure to obtain a sharp change from a first fluid product to a second or following product.

SUMMARY OF THE INVENTION

Briefly, the invention concerns a blending vessel for continuous mixing of a plurality of ingredients for producing a plurality of products in seriatim. The vessel comprises plural first and second ingredient input means connected to said vessel, and first and second output means for said products. It also comprises means for variably dividing said vessel while maintaining said first input and output means separate from said second input and output means.

Again briefly, the invention concerns a cylindrical blending vessel for continuous mixing of a plurality of fluid ingredients for producing a plurality of products in seriatim. It comprises in combination a first plurality of input conduits connected to one end of said vessel for introducing said ingredients of one of said products, and a first mixing means connected to said one end of said vessel for mixing said ingredients in said vessel. It also comprises a first output conduit connected to said one end for carrying said one of said products after said ingredients are mixed, and a second plurality of input conduits connected to the other end of said vessel for introducing said ingredients of another of said products. It also comprises a second mixing means connected to said other end of said vessel for mixing said other product ingredients in said vessel, and a second output conduit connected to said other end for carrying said other one of said products after said ingredients are mixed. It also comprises a thin flat piston having a piston rod for supporting it transversely in said cylindrical vessel. And, said piston is reciprocally movable in said vessel from one extreme position to the other, while maintaining said one end of said vessel separate from said other end. It also comprises switch means associated with said piston rod for controlling said first and second mixing means, relative to said extreme positions of said piston.

Once more briefly, the invention concerns a method of blending and continuously supplying a plurality of products with a sharp change from one product to the next. It comprises the steps of blending one product by mixing constituents thereof in a vessel and delivering said one product to an output supply. And, it comprises introducing the constituents of another product to said vessel in displacement of said one product, while maintaining said other product separated from said one product. It also comprises the steps of blending said other product by mixing constituents thereof in said vessel, while continuing to deliver said one product until said other product has completely displaced said one product. And, it comprises switching said output supply to receive said other product without any mixing of said two products.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

As indicated above, this applicant has heretofore devised a system which is described in U.S. Pat. No. 3,608,869 which covers a system for automatically blending liquid ingredients in a desired ratio to produce a continuous stream of the blended mixture. An important feature of that invention relates to use of a mixing vessel wherein the ingredients are combined by mechanical stirring. However, a drawback to that patent system is that upon changing products, there is a time lag during which the composition gradually changes from the first product blend to the second. This results in a considerable amount of off-test product that must be cut from the stream being produced. But, a method which may use a mixing vessel according to this invention will overcome that drawback.

Figure 1:
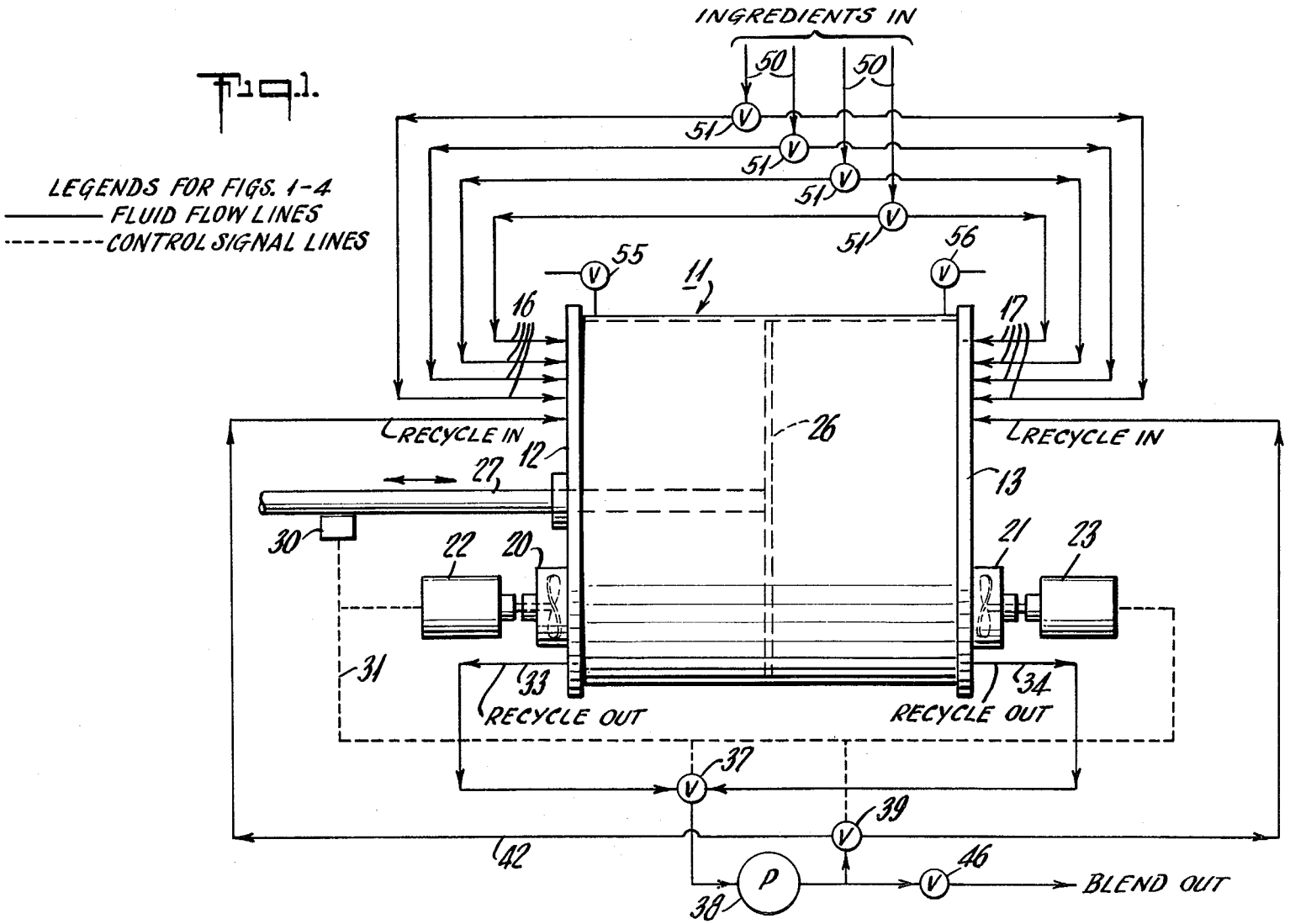
FIG. 1 is a schematic diagram illustrating the principal elements of a blending vessel along with connected elements for carrying out the invention.

Referring to FIG. 1, there is a schematic showing which illustrates a blending vessel according to the invention along with elements of the system that may be employed for introducing the ingredients of products to be blended. Thus, it will be observed that there is a cylindrical blending vessel 11 which is closed at each of its two ends 12 and 13.

There are a group of four input conduits 16 at the end 12 of the vessel 11. These conduits 16 are schematically indicated by arrows, and it will be understood that there may be any number of ingredients. The particular product blend desired will be made up of predetermined percentages of the ingredients. Four inputs are shown for illustrative purposes, and in FIGS. 2, 3 and 4 there are only three inputs in order to simplify those showings.

Similarly, there is another group of input conduits 17 that connect into the end 13 of the vessel 11. Here again, these conduits 17 are indicated schematically by arrows, and the manner of introducing the desired percentages may follow the description of my above noted patent.

There is a mixer 20 connected to the end 12 of the vessel 11 for stirring the fluids in the left hand end of the vessel 11, as viewed in the drawings. And, there is another mixer 21 that is connected to the other end 13 of the vessel 11 for stirring the fluids in the right hand end. It may be noted that these mixers 20 and 21 are powered in any feasible manner such as by motors 22 and 23, respectively.

Inside the vessel 11 there is a thin, flat follower piston 26 that is supported transversely relative to the interior chamber of the vessel, by a piston rod 27. The piston 26 is reciprocally movable longitudinally within the cylindrical chamber of vessel 11. It is arranged so that it has a sliding seal clearance with the inside walls of the vessel 11 in order to maintain each end of the vessel separate from the other on opposite sides of the piston.

It may be noted that the piston 26 is freely movable from either of two extreme positions against one or the other of the ends 12 and 13 of the vessel 11. Consequently, the mixers 20 and 21 are mounted in recesses from the interior of the vessel 11 so as to have the moving elements clear of the piston 26 when it is at its extreme position in either case.

There is a switch means 30 that is schematically indicated. It is associated with the piston rod 27 so as to provide a signal at each of the extreme positions of the piston 26. It will be understood that motors 22 and 23 might be electrical or pneumatic and that there are control signal lines 31 which are schematically indicated by dashed lines.

In addition to the ingredient input conduits 16 at the end 12 of the vessel 11, there is an output conduit 33 for carrying the blended product out. Similarly, at the other end 13 of the vessel 11 there is an output conduit 34 which carries blended product out from that end.

There is a valve 37 which acts to connect either the output conduit 33 or the output conduit 34 to a pump 38. The output of the pump 38 goes jointly to another valve 39 and to a valve 46 in the final output line. The valve 39 is for connecting the fluid from the pump 38 to either a recycle conduit 42 or another recycle conduit 43, depending upon which of the output conduits 33 or 34 is connected to the threeway valve 37. As indicated previously, the pump 38 has its output also connected to the valve 46 for controlling the output of the blend that is being delivered.

It may be noted that, as already indicated, the system is only schematically illustrated. The fluid flow lines for indicating conduits are represented by the solid line arrows, while the control signal lines are indicated by dashed lines. These are both indicated by the legends for FIGS. 1–4 that are shown with FIG. 1. Thus, it will be appreciated that the switch means 30 acts to provide appropriate control signals over the control lines 31 indicated. The control signals act to have the appropriate mixer motor 22 or 23 energized during the time when the corresponding valve 37 or 39 is set for recycling the blend being mixed in the corresponding portion of vessel 11.

The ingredients for a given product may be supplied via the conduits 16 or 17 in any feasible manner. For example, they may be introduced in the manner shown and described in my above noted U.S. Pat. No. 3,608,869.

Figure 2:
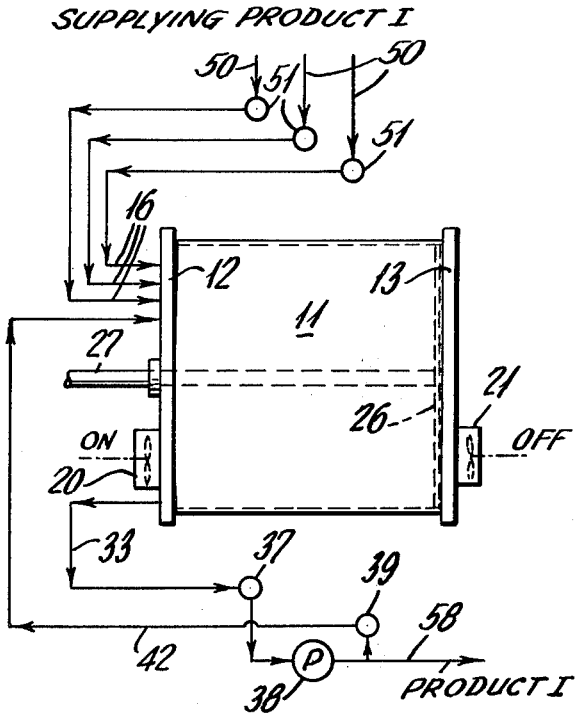
FIG. 2 is a schematic diagram illustrating operative conditions when a first product is being supplied.
Figure 3:
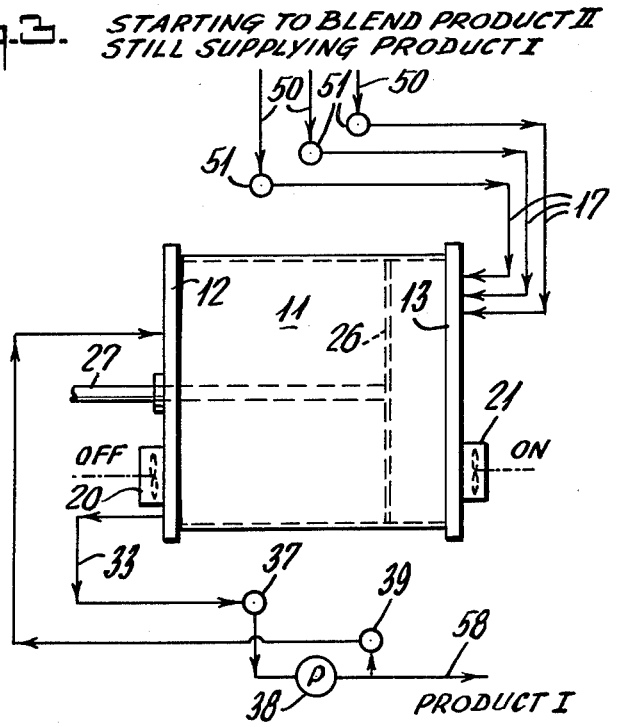
FIG. 3 is a schematic diagram like FIG. 2 but illustrating operative conditions when a second product is commencing to be blended, while the first product continues to be supplied.
Figure 4:
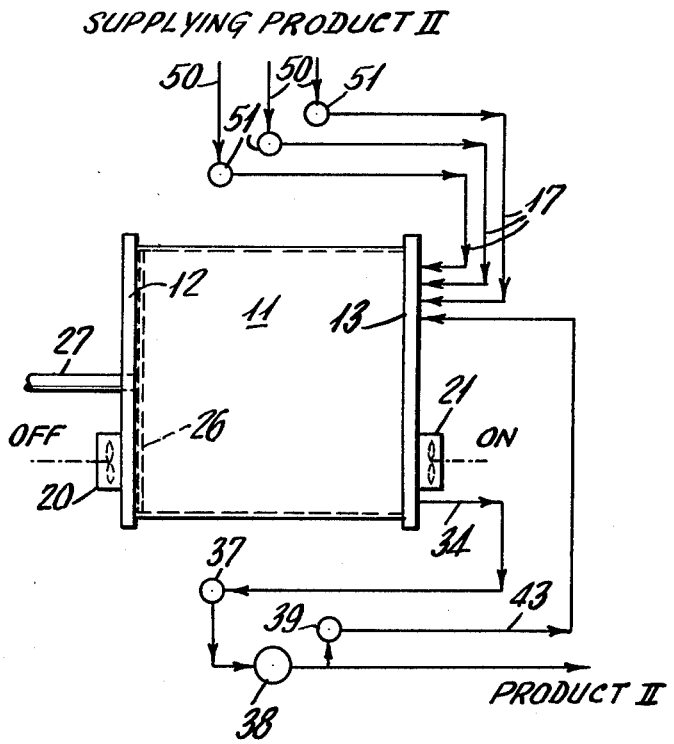
FIG. 4 is a schematic diagram like FIGS. 2 and 3 but showing operative conditions when the second product is being supplied after change over from the first product.

In the applicant's system which is illustrated in FIG. 1, there are four conduits 50 (only three of which are shown in FIGS. 2, 3 and 4 in order to simplify those showings) that are connected to valves 51 for selectively connecting ingredients from conduits 50 to the input conduits 16 or 17 as desired.

The vessel 11 may have air vent valves 55 and 56 that are employed for bleeding any air which might be entrapped within the vessel 11, at either end.

OPERATION

With reference to FIGS. 2, 3 and 4, the operation of a blending vessel according to this invention, will be described. FIG. 2 illustrates the active elements when a first product, designated Product I, is being mixed and the blend is being delivered. Thus, ingredients of the product I are being supplied through conduits 50 that are connected through the valves 51 to the input conduits 16 at the end 12 of the vessel 11. The piston 26 is at its extreme location adjacent to the other end 13 of the vessel 11, and the mixer 20 is on for mixing the ingredients to produce the blended product I. The blended product will go out through the output conduit 33 to the valve 37 and then to the pump 38 for delivery through the product conduit 58. At the same time it is being recirculated in part, as necessary, via the other valve 39.

Next, when a different product is to be blended to follow the product I, it will be introduced to the other end 13 of the vessel 11. This is indicated in FIG. 3. As the ingredients for this next product (designated Product II) are introduced into the vessel 11 through the end 13, they will commence to be mixed by the mixer 21 at the end 13. This introduction and mixing action will commence displacing the piston 26 causing it to move toward the other end 12. Such displacement of the piston 26 will continue to cause product I to flow out as described above (in connection with FIG. 2) so that product I will continue to be supplied to the product output over the product conduit 58.

Thus, when the piston 26 reaches its other extreme position (adjacent to the end 12) which is illustrated in FIG. 4, the shift from product I to product II will be sudden by shifting the valves 37 and 39 so as to connect the flow of blended fluid in the manner indicated in FIG. 4, for delivering product II.

Figure 5:
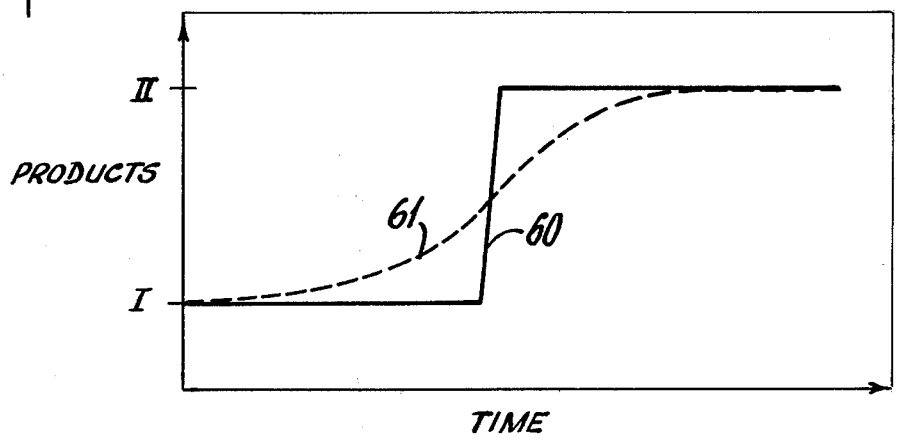
FIG. 5 is a graph illustrating the change from one product to the next on a time scale and comparing the change with prior art conditions.

FIG. 5 is a graph which illustrates the sharp change from product I to product II. The abscissa represents time while the ordinate represents the products I and II, as indicated on the vertical coordinate. Thus, the change from product I to product II takes place suddenly in a sharp manner as indicated by a vertical portion 60 of the solid line curve. In contrast, under the previous arrangement (according to my prior patent indicated above) the product change would be gradual from product I to product II. This is indicated by a dashed line curve 61. It will be observed that for a considerable time period the product would not be in accordance with the specifications for either product I or product II, as contrasted to this invention which provides for substantially no off specification product in a shift from product I to product II.

METHOD

This invention includes a method of blending for continuous supply of fluid products that may make use of apparatus in accordance with the foregoing structure described and illustrated, but might be carried out with any other and different apparatus for accomplishing the desired steps. Thus, the steps involved which are not necessarily in the order described, include a step of blending one product by mixing the constituents thereof in a vessel and delivering such products to an output supply. This step is illustrated by the FIG. 2 indication, where the vessel is being employed for the mixing to blend the constituents and supply the desired product at the output line.

Another step is that of introducing the constituents of another product to the vessel in displacement of the first product, while maintaining such first product separated from the other product. Such a step is indicated by the FIG. 3 illustration where it will be observed that the constituents have been shifted so as to be introduced at the end 13 of the vessel 11. These constituents, of course, may be different in relationship or actual consistencies, as desired, in order to produce the different product which is to be blended for delivery following the previous product.

A next step is the blending of this next product by mixing the constituents thereof in the vessel while continuing to deliver the first product until it has been completely displaced from the vessel and delivered to the output line. In this manner, the second product is being blended by mixing its constituents and it is thus ready to be delivered in the desired form as the next product, in seriatim.

Finally, a step for changing to the second product is that of switching the output supply so as to receive the second product without any substantial mixing of the two products. It will be appreciated that this might be carried out as indicated by the foregoing description relating to FIG. 4, which shows conditions after the first product has been completely moved out from the vessel 11 and the valves have been switched over so that the next product will be delivered to the product line.

While particular embodiments of the invention have been described above in considerable detail in accordance with the applicable statutes, this is not to be taken as in any way limiting the invention but merely as being descriptive thereof.

I claim:

1. Cylindrical blending vessel for continuous mixing of a plurality of ingredients for producing a plurality of products in seriatim, comprising plural first and second ingredient input means connected to said vessel, first and second output means for said products, means for variably dividing said vessel while maintaining said first input and output means separate from said second input and output means, comprising a piston reciprocally movable in said vessel, means for permitting movement of said piston from one extreme position to the other as one of said products is terminated and the next product is commenced, and first and second mixing means associated with the ends of said vessel for mixing the products in the respective ends thereof.

2. Blending vessel according to claim 1, wherein said piston is a flat plate, and said means for permitting movement comprises a piston rod for supporting said flat plate transversely in said cylindrical vessel.

3. Blending vessel according to claim 2, also comprising switch means associated with said piston rod for controlling said first and second mixing means relative to said extreme positions of said piston.

4. Cylindrical blending vessel for continuous mixing of a plurality of fluid ingredients for producing a plurality of products in seriatim, comprising in combination a first plurality of input conduits connected to one end of said vessel for introducing said ingredients of one of said products, a first mixing means connected to said one end of said vessel for mixing said ingredients in said vessel, a first output conduit connected to said one end for carrying said one of said products after said ingredients are mixed, a second plurality of input conduits connected to the other end of said vessel for introducing said ingredients of another of said products, a second mixing means connected to said other end of said vessel for mixing said other product ingredients in said vessel, a second output conduit connected to said other end for carrying said other one of said products after said ingredients are mixed, a thin flat piston having a piston rod for supporting it transversely in said cylindrical vessel, said piston being reciprocally movable in said vessel from one extreme position to the other while maintaining said one end of said vessel separate from said other end, and switch means associated with said piston rod for controlling said first and second mixing means relative to said extreme positions of said piston.

5. Method of blending and continuously supplying a plurality of products with a sharp change from one product to the next, comprising the steps of blending one product by mixing constituents thereof in a vessel and delivering said one product to an output supply, introducing the constituents of another product to said vessel in displacement of said one product while maintaining said other product separated from said one product, blending said other product by mixing constituents thereof in said vessel while continuing to deliver said one product until said other product has completely displaced said one product, and switching said output supply to receive said other product without any substantial mixing of said two products.

* * * * *